US005933080A

United States Patent [19]

Nojima

[11] Patent Number: 5,933,080

[45] Date of Patent: Aug. 3, 1999

[54] EMERGENCY CALLING SYSTEM

[75] Inventor: Akihiko Nojima, Toyota, Japan

[73] Assignee: Toyota Jidosha Kabushiki Kaisha, Toyota, Japan

[21] Appl. No.: 08/982,691

[22] Filed: Dec. 2, 1997

[30] Foreign Application Priority Data

Dec. 4, 1996 [JP] Japan ..... 8-324359

[51] Int. Cl.[6] ..... G08B 1/08

[52] U.S. Cl. ..... 340/539; 340/531; 340/825.36; 340/825.49; 342/357; 379/37; 379/45

[58] Field of Search ..... 340/539, 531, 340/825.36, 825.49; 342/450, 357; 379/37–40, 45

[56] References Cited

U.S. PATENT DOCUMENTS

| | | | |
|---|---|---|---|
| 5,218,367 | 6/1993 | Sheffer et al. | 342/457 |
| 5,223,844 | 6/1993 | Mansell et al. | 342/357 |
| 5,278,539 | 1/1994 | Lauterbach et al. | 340/539 |
| 5,742,233 | 4/1998 | Hoffman et al. | 340/539 |

FOREIGN PATENT DOCUMENTS

| | | |
|---|---|---|
| 2-007200 | 1/1990 | Japan . |
| 6-020191 | 1/1994 | Japan . |
| 6-036185 | 2/1994 | Japan . |

*Primary Examiner*—Donnie L. Crosland
*Attorney, Agent, or Firm*—Pillsbury Madison & Sutro LLP

[57] ABSTRACT

A Mayday contact address database (20) is connected to a navigation control (10). The Mayday contact address database (20) stores emergency contacts which shall be given an emergency report in what priority according to factors such expressway, ordinary road, human involved accident or damage only accident. Therefore, emergency reports can be made in an appropriate order according to the Mayday contact database (20). Transmission methods can be determined according to stored data. By transmitting a Mayday standby call from a two-way communications device (22) to a Mayday center (24), the Mayday center (24) presumes the occurrence of an emergency if no reset call has been received within a predetermined time.

26 Claims, 7 Drawing Sheets

| | | POLICE STATION | FIRE DEPART-MENT | ROAD ADMINIS-TRATOR | SENDING AND REPAIR COMPANY | CAR DEALER | WORK PLACE | HOME | REQUIRED RESPONSE |
|---|---|---|---|---|---|---|---|---|---|
| PERSON-INVOLVED ACCIDENT | EXPRESSWAY | 2 | 3 | 1 | 4 | 7 | 6 | 5 | ○ |
| | ORDINARY ROAD | 1 | 2 | | 3 | 6 | 5 | 4 | ○ |
| DAMAGE ONLY ACCIDENT | EXPRESSWAY | 2 | | 1 | 3 | 4 | | | ○ |
| | ORDINARY ROAD | 1 | | | 2 | 3 | | | △ |
| TROUBLE | EXPRESSWAY | | | 1 | 2 | 3 | | | ○ |
| | ORDINARY ROAD | | | | 1 | 2 | | | △ |
| POOR PHYSICAL SHAPE | EXPRESSWAY | | 2 | 1 | | | 4 | 3 | ○ |
| | ORDINARY ROAD | | 1 | | | | 2 | 3 | ○ |

Fig. 2

EMERGENCY CALLING SYSTEM

BACKGROUND OF THE INVENTION

1. Field of the Invention

The invention relates to an emergency calling system. The system includes a vehicle station which detects its location and transmits information on its location and a Mayday center which performs two-way communication with the vehicle station and which monitors the two-way communication.

2. Description of the Related Art

Various types of equipment have been installed on vehicles to secure safer running. However, no matter how safety is improved, some accidents will still occur. Or, an occupant of a vehicle might suddenly become ill. In case of such an emergency, it would be desirable to quickly and accurately make an emergency call to concerned agencies or sources of help.

Under such circumstances, Japanese Patent Laid-Open Publication No. Hei 6-20191 proposes a system which, in case of an accident, automatically transmits a driver's location to an emergency contact, such as a fire department, and which also intermittently sends the location of a vehicle to an emergency contact if there is felt to be a risk that an emergency situation might occur. This system is designed so that an emergency contact can presume the occurrence of an accident even if an emergency calling device is disabled due to an accident and can also know the location of the vehicle. This publication also discloses that a plurality of emergency contacts are given an order of priority and emergency calls are performed in that order.

Japanese Patent Laid-Open Publication No. Hei 6-36185 proposes a system that when an accident occurs outside an area communicable with an emergency contact address, an emergency call is made to another vehicle by vehicle-to-vehicle communications. According to this system, an emergency call can be made even when an accident occurrs outside the area communicable with the emergency contact address.

The system disclosed in Japanese Patent Laid-Open Publication No. Hei 6-20191 cannot, however, detect the occurrence of an emergency if such an incident occurs outside an area communicable with an emergency contact. The order of priority is predetermined to enable emergency calling, but it is often necessary to select an emergency contact according to the circumstances of the accident or to select a communications method according to the emergency contact. That system has a drawback that it cannot meet such needs.

The system disclosed in Japanese Patent Laid-Open Publication No. Hei 6-36185 has a disadvantage that an emergency call cannot be made if another communicable vehicle is not available and its reliability is therefore poor.

SUMMARY OF THE INVENTION

It is an object of the present invention to provide an emergency calling system which can make an appropriate emergency call by appropriate means and can reliably detect the occurrence of an emergency.

According to the invention, when it is necessary to make an emergency call about a vehicle station, a Mayday center performs an emergency call to a plurality of emergency contacts in an order of priority according to the vehicle station's present location.

Thus, the order of priority of the emergency contact addresses is determined according to vehicle station location. Therefore, the order of priority of the emergency contact addresses can be changed depending on, for example, whether the road is an expressway or an ordinary road, so that emergency calls can be made in an optimum order.

Also, according to the invention, when it is necessary to make an emergency call concerning a vehicle station, a Mayday center selects a communications method according to a plurality of emergency contacts to make the emergency call to such an emergency contacts.

Since the communications method is selected according to the contact, an appropriate call can be made to that contact. The communications method can also be selected according to the desired or required response. In addition, the communications method can be selected taking expenses into consideration.

The invention can select a communications method from a plurality of communications methods according to the contents of an emergency call. For example, importance is attached to respective communications methods in advance and then used to select an appropriate communications method among them. Also, by modifying importance according to the contents of the emergency call, a more appropriate communications method can be selected. For example, when the level of an emergency is relatively low, an inexpensive communications method can be selected. Thus, an optimum communications method can be selected according to the specific circumstances at the time.

According to the invention, transmission from a vehicle station to the Mayday center is performed at a frequency predetermined for the emergency call. By transmitting from the vehicle station to the Mayday center at a fixed frequency, the occurrence of an emergency can be transmitted with reliability. Since the call from the Mayday center is made by a method selected from among a variety of communications methods, the call can be made appropriately to a plurality of contact locations. Simultaneous communications are also possible.

The invention transmits a Mayday set call from a vehicle station when necessary and includes an expected time of transmission of a Mayday reset call into the Mayday standby call. Therefore, the Mayday center can presume the occurrence of an emergency when it does not receive the Mayday reset call. For example, if there is an incommunicable or a risky area, the vehicle station transmits a Mayday standby call before entering such an area and then transmits a Mayday reset call after leaving the pertinent area. Thus, the Mayday center can presume the occurrence of an emergency based on the absence of a Mayday reset call.

When a particular route is set, entrance into such an area can be readily predicted. And, in a system in which the vehicle station gives information on its location to the Mayday center at predetermined time intervals using two-way communication, the Mayday center can predict when the vehicle station enters and leaves such an area. Thus, the vehicle station can simply make the two-way communication, while the Mayday center sets and resets the Mayday standby.

BRIEF DESCRIPTION OF THE DRAWINGS

FIG. 2 is a chart showing the order of priority of emergency contact addressees.

DETAILED DESCRIPTION OF THE PREFERRED EMBODIMENTS

Preferable embodiments of the invention will be described with reference to the accompanying drawings.

General configuration of the system

Figure 1:
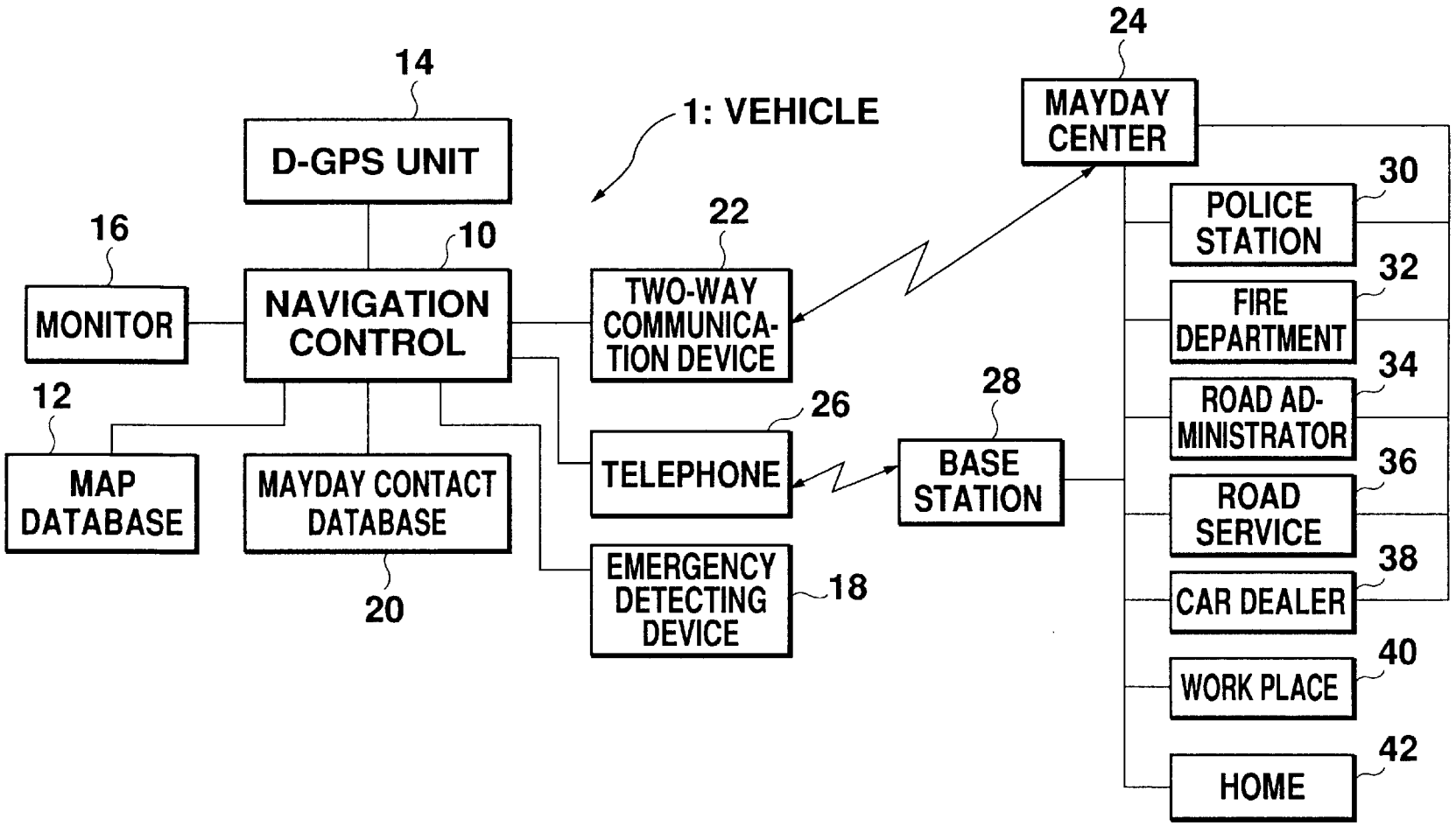
FIG. 1 is a diagram showing the general configuration of a system according to this invention.

FIG. 1 shows the general configuration of a system according to this invention. A vehicle 1 operating as a vehicle station is provided with a navigation control 10. The navigation control 10 is connected to a map database 12 containing various map information and a D-GPS (Differential Global Positioning System) unit 14 for detecting the present location of the vehicle 1. Based on the map data of the map database 12 and the present location detected by the D-GPS unit 14, the navigation control 10 performs the necessary processing for displaying a route in the same manner as a common navigation system. The D-GPS unit 14 combines a GPS-positioned location obtained by receiving signals from GPS satellites and error information obtained from FM multiplex broadcasting, to obtain more accurate information about the location of the vehicle station. A monitor 16 connected to the navigation control 10 displays the route.

The navigation control 10 is also connected to an emergency detecting device 18. The emergency detecting device 18 comprises an air bag activation signal, a user activated panic button, and other inputs, and is also connected to a Mayday contact database 20. The Mayday contact database 20 stores a plurality of contact locations which, in the event of an emergency, would be notified according to a priority scheme based on various conditions. In case of an emergency, the navigation control 10 refers to the Mayday contact database 20 to send an urgent notification.

The navigation control 10 is also connected to a two-way communications device 22. This two-way communications device 22 is connected to a Mayday center 24 by means, such as radio for example, to transmit the vehicle location to the Mayday center 24 at predetermined time intervals. The Mayday center 24 monitors the vehicle 1 according to the location information received from the two-way communications device 22. If the navigation control 10 detects an emergency, the two-way communications device 22 operates to establish two-way communication with the Mayday center 24. The transmission from the Mayday center 24 to the two-way communications device 22 is performed at a fixed frequency.

The navigation control 10 is further connected to a telephone 26 so that the navigation control 10 can use radio communications with a base station 28 to call over the telephone. This telephone 26 can also be used as an ordinary telephone.

A police station 30, fire department 32, road administrator 34, road service organization 36, dealer 38 and the like are connected to the Mayday center 24 on exclusive dedicated lines. According to data transmitted from the vehicle 1, the Mayday center 24 can send an emergency report to such institutions. The Mayday center 24 is also connected to the police station 30, fire department 32, road administrator 34, road service organization 36, and car dealer 38 on telephone lines. The Mayday center 24 can also call the driver's work place 40 or home 42 over the telephone. The telephone 26 of the vehicle 1 can also be used to communicate with any institutions which are connected to telephone lines through the base station 28. The road administrator 34 is an administrator of a toll road or the like, and the road service organization 36 dispatches personnel to repair (temporary repairs) a vehicle, tow a vehicle to a repair shop (including a car dealer), as well as other services. An example of such an organization would be the Road Service Division of the Japan Automobile Federation. The car dealer 38 is a source of automobiles, related parts, and automobile repairs.

Configuration of Mayday contact address database

FIG. 2 illustrates a configuration of the Mayday contact address database 20. The order of emergency contact addresses is stored according to the cause of the emergency report. For example a person-involved accident has a higher priority than a damage only accident, and mechanical trouble has higher priority than poor physical shape. Each cause also considers the type of road (e.g., an expressway or ordinary road) the emergency occurred on. In case of a person-involved accident on an expressway, for example, the emergency contact addresses are stored in the order of priority are: the road administrator 34, the police station 30, the fire department 32, the road service organization 36, the home 42, and the work place 40. The telephone numbers of such contact addresses are also stored in the Mayday contact database 20. In addition, since some institutions are not available depending on time of day, data on accessibility by time of day is also stored in the Mayday contact database 20.

The Mayday contact database 20 also stores data for a required response. The Mayday contact database 20 may be stored in the Mayday center 24 in accordance with the respective vehicles 1 registered therein. The Mayday contact database 20 may also be divided into two databases according to the content and stored separately in the vehicle 1 and the Mayday center 24, or may be stored duplicate in both the vehicle 1 and the Mayday center 24, for example, with data other than private matters such as work place and home being stored in the Mayday center 24.

The content of the Mayday contact address database 20 are kept up to date by periodic communication with the Mayday center 24. They may also be updated according to information from various types of information service centers in addition to the Mayday center 24.

FIG. 2 depicts one vehicle 1, one Mayday center 24, one base station 28, one police station 30 and one each of other institutions, but they are in practice established by a given jurisdiction and are present in larger numbers.

Transmission

Figure 3:
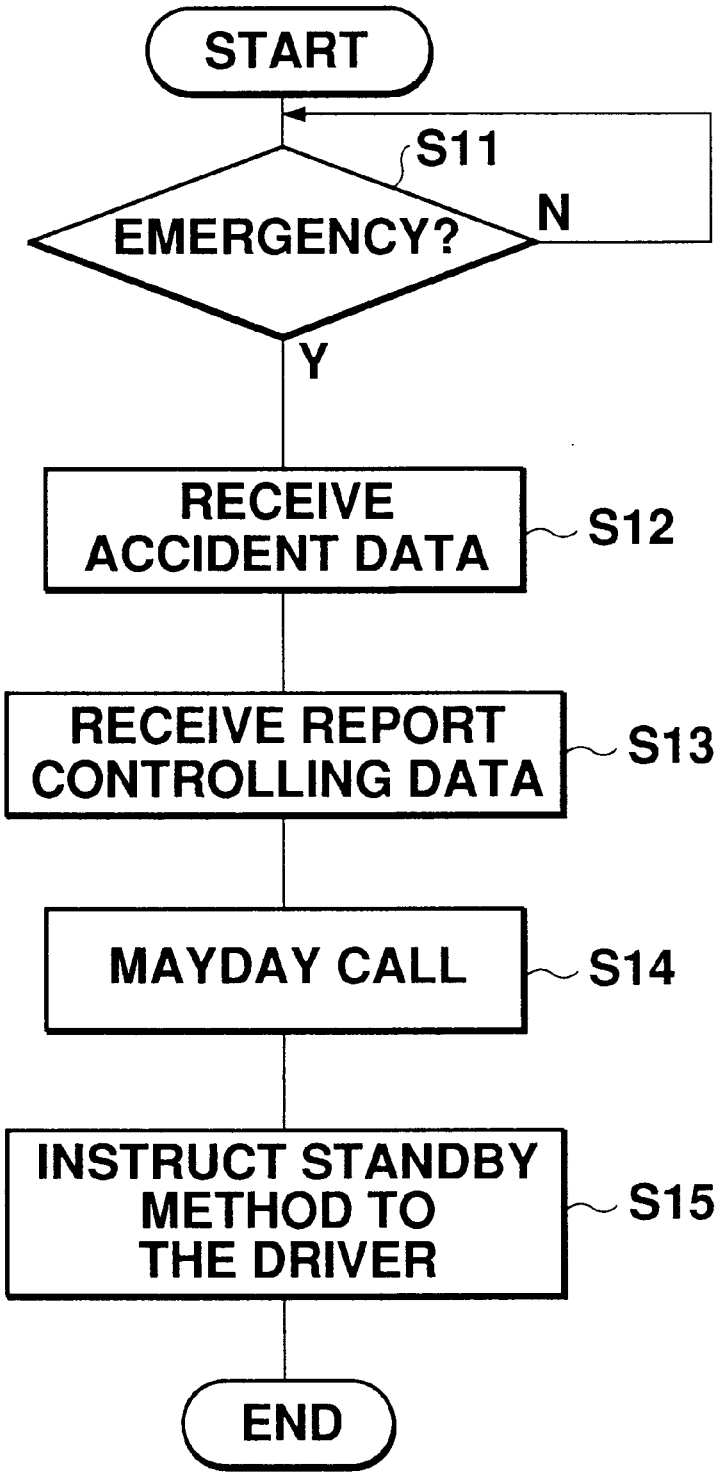
FIG. 3 is a flowchart showing an operation to send a Mayday call from a vehicle.

The operation of making an emergency call is described with reference to FIG. 3. The navigation control 10 always checks the detected results by the emergency detecting device 18 to judge whether an emergency has occurred (S11). When it is judged that an emergency has occurred, accident data such as location information, type of road and type of accident are collected (S12) Specifically, the present location of the vehicle is obtained from the D-GPS unit 14, and, based on the present location, the type of road is identified in view of the map information taken from the map database 12. The present location is obtained as an address or its neighboring mark on an ordinary road or a location on an expressway, e.g., "at a 702-Km post heading into Tokyo on the Tomei Expressway" and a vehicle ID, such as a license plate number, for identification of the vehicle is also provided. In addition, the type of accident is determined. For example, if an air bag was deployed, it is judged as a person-involved accident, while if the panic button was operated, the type of accident will be as identified by the user (i.e., driver).

Then, according to the obtained accident data, report controlling data such as the address, the order of priority of contact addresses, and the required response are collected with reference to the Mayday contact address database 20 (S13). Accident data, such as location information and accident type, and reporting data, such as road type and reporting order, are reported (i.e., Mayday calling) to the Mayday center 24 by the two-way communications device 22 (S14). Communications by the two-way communications device 22 are made at a predetermined fixed frequency.

When the Mayday call is completed, a standby method or the like is provided to the driver (S15). For example, the driver is instructed to place a triangle sign to indicate an emergency stop. Such instructions are also displayed plainly on the monitor 16.

Meanwhile, the Mayday center 24 which has received the report communicates successively according to the order specified by the communications control data contained in the report. The Mayday center 24 is connected to the police station 30, the fire department 32, the road administrator 34, the road service organization 36, and the car dealer 38 through private lines. Generally, the driver's company 40 and home 42 are not connected to the Mayday center 24 on the private line. Therefore, the Mayday center 24 makes an emergency report to the company 40 and the home 42 over the telephone. Alternative communication methods such as facsimile, a beeper, or the like may also be used when necessary. Satellite transmission is preferably used depending on the contact. The Mayday center 24 determines a communications method (a use media) according to the contact to make an emergency report. The communications method to communicate with each contact is determined by the Mayday center 24. It is desirable that a plurality of communications methods be determined for each contact and an appropriate one be selected as required.

The communications control data also includes data on the required response. Generally, the Mayday center 24 has a plurality of lines. If the required response is high, communications may be made simultaneously in a range that transmission can be made using the plurality of lines. The communication content may be the same as those of communications to a contact with the highest priority. If the required response is not high, the communication content can be confirmed by means such as calling the driver on a car telephone before sending personnel from the road service organization 36 to the spot.

When the Mayday contact database 20 is located at the Mayday center 24, it is not necessary to obtain communications control data from the vehicle 1. Based on the received accident data, the Mayday center 24 determines the order of priority and required response of the contact to make the emergency report described above. The communications methods of the respective contact addresses are preferably stored in the same manner as in the table shown in FIG. 2.

If the Mayday center 24 or the like is monitoring other vehicles in the neighborhood of the vehicle involved in the accident, it is desirable to inform such vehicles of the accident. Such information maybe given by sending data to the two-way communications devices 24 of the neighboring vehicles or by using the telephone 26. In addition, such information is not limited that it must be given by the Mayday center 24, so that the occurrence of multiple accidents can be prevented.

The map database 12 also contains the vehicle location and information on the emergency contacts (e.g., the controlling Mayday center 24, the police station 30, the road service organization 36 and others). Therefore, if an accident occurs, contacts to which an emergency report is made can be recognized by the navigation control 10 of the vehicle 1. Even if the two-way communications device 22 cannot communicate with the Mayday center 24, the vehicle 1 can directly communicate with various contacts over the telephone lines. It is preferable that communications be made to the contact addresses in the order of priority according to the Mayday contact database 20.

If a contact has a variety of phone systems such as PHS (Personal Handyphone System) or a mobile telephone, communications can be made to that system which can be used at the relatively lowest cost when the required response is low.

Furthermore, the telephone 26 may include a PHS, a mobile telephone; and a car telephone which can be used selectably according to the required response. For example, when the required response is low, PHS can be used at a low charge, and if PHS cannot be used to communicate, the mobile telephone or the car phone can be used. When the required response is high, the car phone can be used from the beginning to inform quickly. Thus, a communication method with an appropriate expense can be selected according to urgency level.

According to a human-involved accident or a damage only accident, the navigation control 10 changes the importance of each communications method, compares the communications methods with the weight taken into account, and selects an appropriate communications method. Thus, the communications method can be selected with ease. For example, assuming that when the required response is ○, the car phone is assigned "1" and PHS is assigned "0", and when the required response is Δ, the car phone is assigned "0" and PHS is assigned "1". Selecting the car phone or PHS depends on which one has the higher value.

When the telephone 26 is used to make an urgent report, monitor 16 is preferably used as a guide so that the report can be made accurately. For example, if an accident occurs on an ordinary road, in addition to the display of the present location on the map covering the circumference of the scene of the accident, it is desirable to display information such as the license plate number for identification of the vehicle 1, the address of the present location, and/or the name of a landmark near the scene. On the other hand, if the accident occurs on an expressway, a mileage post could be used to indicate the scene of the accident. In addition, to call the car dealer over the telephone, it is preferable to display a car model and a diagnosis code or the like obtained by diagnosing the vehicle 1. Thus, because appropriate details are displayed depending on a contact address, the driver can obtain the necessary information to accurately make the emergency report.

Figure 4:
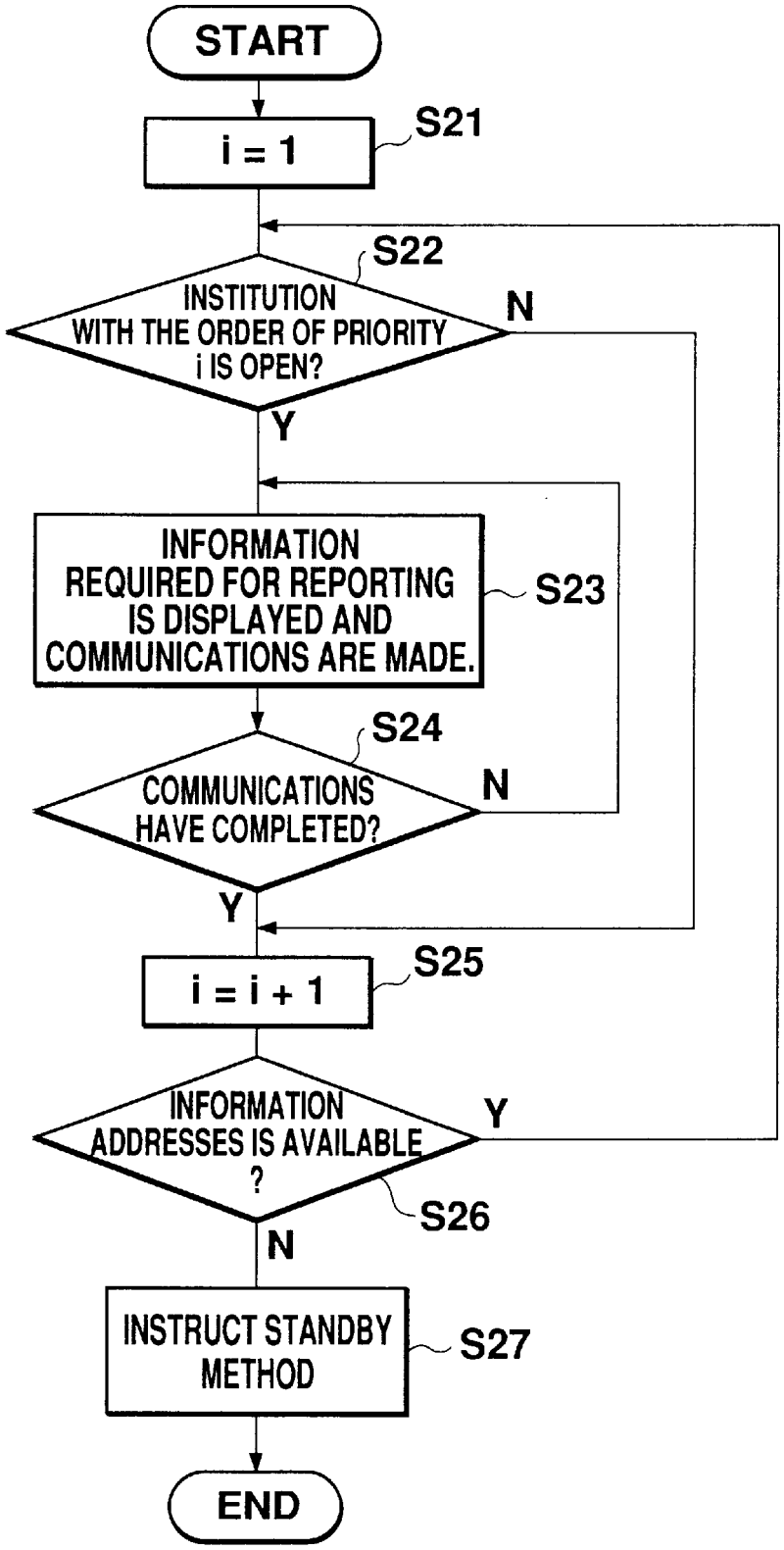
FIG. 4 is a flowchart showing an operation to receive a Mayday call at a Mayday center.

Such a process will be described with reference to a flowchart as shown in FIG. 4. Upon receiving the order of priority and the like in the same way as indicated by the flowchart of FIG. 2, it is determined that variable i=1 (S21), and it is judged whether the contact address with the order of priority i is open or not (S22). If it is open, information needed to make the report is displayed on the monitor and transmitted to the contact address (S23). It is next judged whether or not the communications have been completed (S24) so that communication and display may be continued until the communications are completed.

When the communications are completed or the contact address with the order of priority i is not open, it is determined that i=i+1 (S25), and it is judged whether a contact address with the renewed order of priority i is available (S26) . And, if it is available, the process returns to S22 to repeat the same process. If it is not available, a standby method is instructed to the driver (S27), and the process is terminated.

Second embodiment

Figure 5:
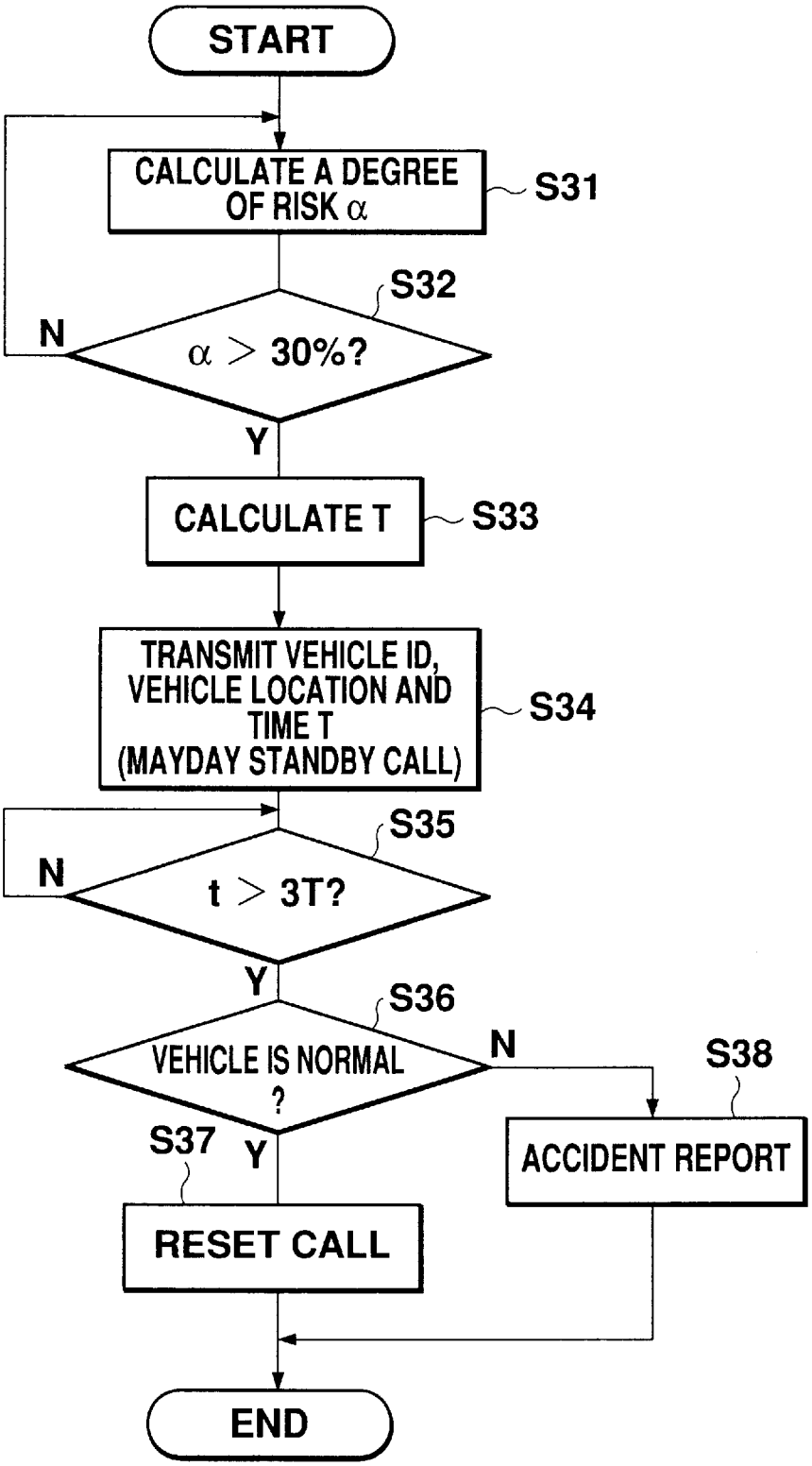
FIG. 5 is a flowchart showing an operation to send a Mayday standby call from a vehicle.
Figure 6:
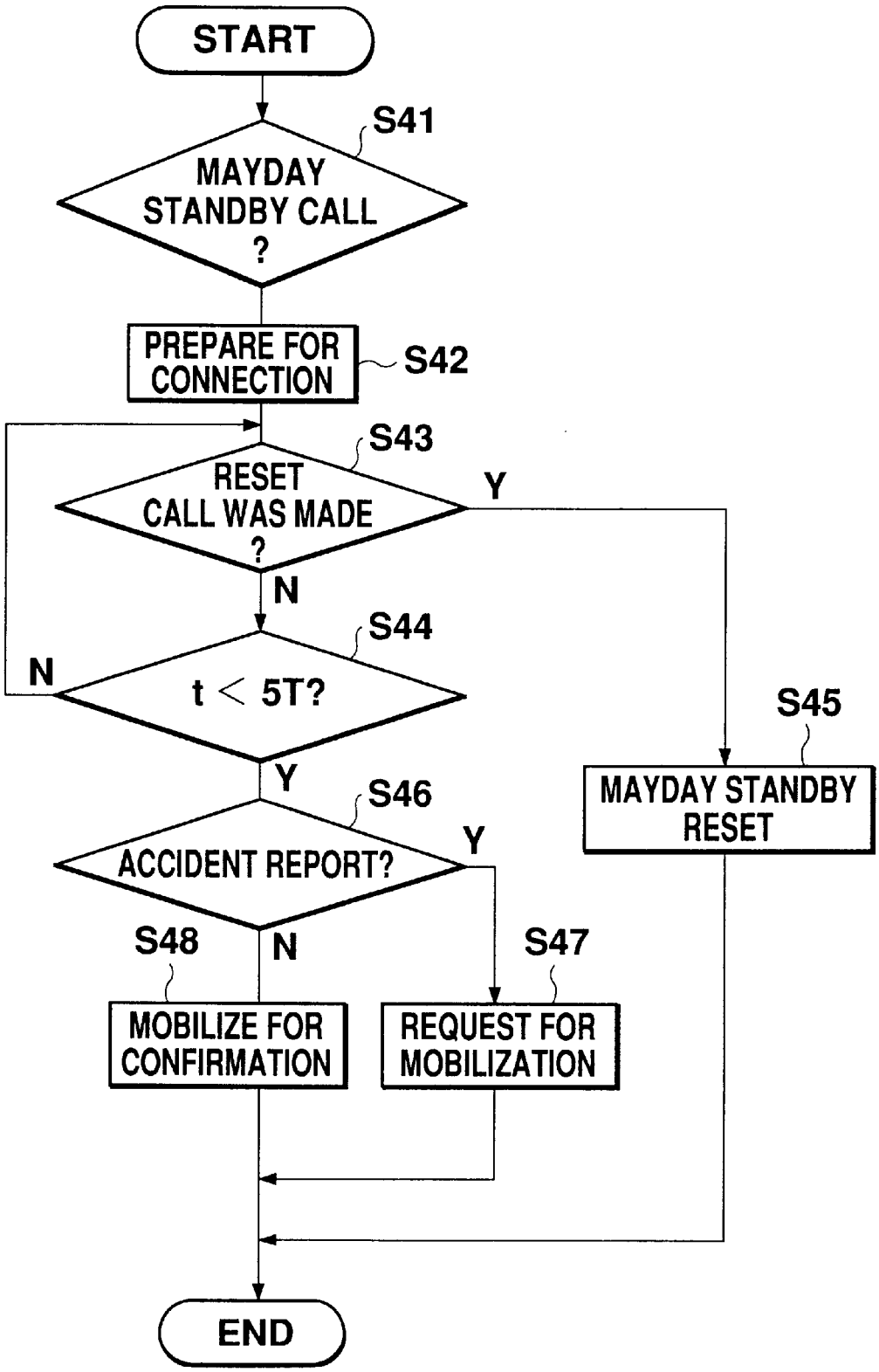
FIG. 6 is a flowchart showing an operation to receive a Mayday standby call at the Mayday center.

The occurrence of a car accident may render the communications device inoperable and disable communications. In such a case, the Mayday center 24 or the like must obtain information on the accident from another vehicle. Such a method, however, may take needed time. Accordingly, this embodiment of the invention performs processes as shown in FIG. 5 and FIG. 6.

A process for the vehicle will be described with reference to FIG. 5. First, a risk is detected (S31). The risk may be detected in view of the relationship between running conditions (i.e., vehicle speed, yaw rate, etc.) or road shape (i.e., curved road, road surface conditions). The risk is determined as a value in a range of 0 to 100%.

It is judged whether the calculated risk is a predetermined value (30% in this case) or higher (S32). Time T in which it can be judged whether an emergency occurred or could be prevented from the moment when the risk becomes 30% is calculated (S33). If the time T could be calculated, the vehicle ID (e.g., the license plate number), the vehicle location, and the time T are transmitted as a Mayday standby call to the Mayday center 24 (S34). It is then judged whether time 3T has passed (S35), and transmission is repeated. At this time, the vehicle location is updated. If time 3T has passed, it is judged whether the vehicle 1 is normal or not (S36).

If the vehicle 1 is normal, a reset call is sent to the Mayday center 24 to inform that the Mayday standby state may be canceled (S37). If it is not normal, an accident report is transmitted (S38). Subsequent to the accident report, various reports may be made on the telephone. The two-way communications device 22 may also be used to make voice communications.

A process for the Mayday center 24 will be described with reference to FIG. 6. Upon receiving the Mayday standby call in S34 from vehicle 1 (S41), the Mayday center 24 prepares to notify the contacts (S42). Specifically, the Mayday center 24 prepares to make an emergency call to the police station 30 and the like for first aid. It is also judge whether a reset call was made within 5T (S43, S44). If a reset call was made, the preparation for connection is reset (S45). On the other hand, if no reset call was received, it is judged that something has happened, and it is determined whether there was an accident report (S46) . If there was an accident report, mobilization is requested to take necessary procedures according to the accident report (S47). However, if no accident report was received, it is still presumed that something has happened, even though details are unknown. Mobilization is then requested to confirm the situation (S48).

As described above, according to this embodiment, the Mayday center 24 enters a Mayday standby condition when a setting call including a vehicle position, an expected time of reset or the like is sent to the Mayday center 24. When no reset call is received, mobilization is requested to check the situation. Accordingly, emergency mobilization can also be made when the vehicle enters a state where it cannot make contact with the Mayday center 24.

For example, if the vehicle goes into a sharp curve without decelerating, the navigation control 10 senses a risky condition and transmits a Mayday standby call. Then, if the vehicle cannot clear the sharp curve and communications are cut off, the Mayday center 24 can presume that something unusual has occurred.

If there is an obstacle ahead of the vehicle on a road that is judged difficult to avoid, a Mayday standby call can be sent so that a subsequently caused accident can be presumed.

Third embodiment

A risk may be judged high when the vehicle is running through a high crime area. By storing such data in the map database 12, a Mayday standby call is sent when the vehicle enters the relevant area, and a reset call is sent when the vehicle leaves the area. The driver can also send a Mayday standby call at his discretion, so that the Mayday center 24 can be in a Mayday standby condition until the vehicle leaves that area. In this case, a "Mayday" lamp which can be seen from outside the vehicle may be mounted on the vehicle in order to deter a crime. If a reset call is not received after the lapse of an expected time, it is presumed that the vehicle might be involved in a crime, and the Mayday center 24 can contact a security organization such as the police station 30 for help in view of the location where the last transmissions were received from.

The time required to pass through a high crime area may be substantially longer than the time before the occurrence of an accident described above, and the time T described above is an expected time of passing through the pertinent area. Time is then not 3T, but a few minutes plus T in S35, and time 5T in S44 is also obtained by adding a few minutes.

A Mayday standby call can also be made at the time of entering an area where communications are restored before entering an area where communications cannot be made with the Mayday center 24 or just before leaving communicable area. A reset call is made when the vehicle goes into the area where communications can be made with the Mayday center 24. Accordingly, if no reset call is received after the lapse of the predetermined time, the Mayday center 24 can judge that something is wrong with vehicle 1.

Especially, the navigation control 10 knows a route after it has been determined. By including data on a range under control of each Mayday center 24 and incommunicable areas into the map database 12, it is possible to judge which ranges in the route are incommunicable areas.

Figure 7:
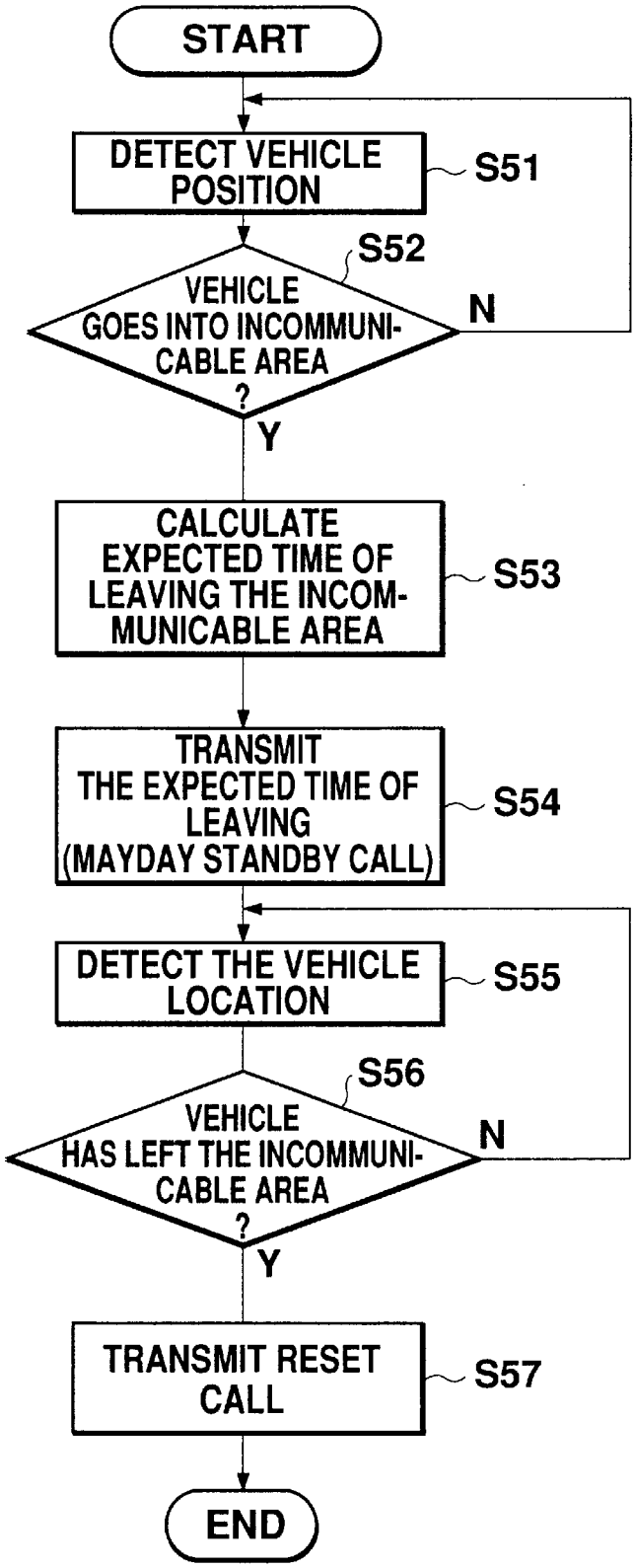
FIG. 7 is a flowchart showing an operation when a vehicle goes into an area where communications cannot be made.

As shown in FIG. 7, the vehicle location is detected (S51) to judge whether the vehicle is going to enter an incommunicable area (S52). If the vehicle is entering such an incommunicable area, an expected time of departure from the incommunicable area is calculated in view of data in the map database 12 and its route (S53). The expected time of departure may be calculated taking into account traffic conditions up to the relevant area and other traffic information. The obtained expected time of departure is transmitted to the Mayday center 24 (S54).

Upon receiving the transmission, the Mayday center 24 enters a Mayday standby state. The vehicle 1 repeatedly detects its location as it is running (S55) and sends the reset call after leaving the incommunicable area (S56, S57). If the vehicle 1 is involved in trouble and cannot leave the incommunicable area, the Mayday center 24 will not receive the reset call, even after a lapse of the expected time of departure. Then, the Mayday center 24 presumes that an emergency has occurred and begins action to check the situation using procedure essentially the same as that shown in FIG. 6. If the vehicle operator decides to stop temporarily in the incommunicable area, the Mayday standby call may be manually canceled.

Also, the route may be transmitted from the vehicle 1 to the Mayday center 24, so that the Mayday center 24 can check the location information being transmitted successively from the vehicle 1 in order to detect the emergency as described above. In other words, the Mayday center 24 predicts communicable areas in the route and the time of departure in view of the time when the vehicle 1 enters the incommunicable area. If no communications are received from the vehicle 1 after passage of the expected time of departure, the Mayday center 24 presumes an emergency situation has occurred. It is to be understood that the expected time of departure contains a margin of error to some extent. Therefore, it is preferable that the expected time of departure be set a little later than the normal time required for the vehicle to leave the pertinent area.

Although the above describes what, at present, are considered to be preferred embodiments of the invention, it is to be understood that various modifications may be made thereto, and it is intended that the appended claims cover all such modifications as fall within the true spirit and scope of the invention.

What is claimed is:

1. An emergency calling system comprising:

a vehicle station having a communications device;

a Mayday center for communicating with the vehicle station and for generating an emergency report on the vehicle station, wherein the vehicle station initiates an emergency call and provides the Mayday center with information regarding an emergency situation and the Mayday center, responsive to the information, generates an emergency report on the vehicle station and provides the emergency report to a plurality of emergency contacts according to a prioritized order based on the location of the vehicle station.

2. The system according to claim 1, wherein the vehicle station is equipped with a means for detecting its present location and informs the Mayday station of its location when an emergency report is necessary.

3. The system according to claim 1, wherein the vehicle station has a table concerning the emergency contacts according to the location of the vehicle station and informs the Mayday center of the order of priority of the plurality of emergency contacts.

4. The system according to claim 1, wherein the Mayday center has a table concerning the emergency contacts according to the location of the vehicle station.

5. The system according to claim 1, wherein emergency transmissions from the vehicle station to the Mayday center are directly performed by radio at a predetermined frequency.

6. The system according to claim 1, wherein a transmission method for the emergency report to the plurality of emergency contact addresses is determined according to the content of the emergency report and according to the respective emergency contacts.

7. An emergency calling system comprising:

a vehicle station having a communications device;

a Mayday center for communicating with the vehicle station and for generating an emergency report on the vehicle station, wherein the vehicle station initiates an emergency call and provides the Mayday center with information regarding an emergency situation and the Mayday center, responsive to the information, generates an emergency report on the vehicle station and transmits the emergency report to a plurality of emergency contacts using one or more transmission methods based on the respective emergency contacts.

8. The system according to claim 7, wherein the transmission method to the respective emergency contact addresses is modified according to the content of the emergency report.

9. The system according to claim 7, wherein the transmission from the vehicle station to the Mayday center is performed at a predetermined frequency for emergency reporting.

10. An emergency calling system comprising:

a vehicle station capable of detecting information regarding its own location and transmitting the location information;

a Mayday center capable of obtaining the location information from the vehicle station, wherein the vehicle station transmits a Mayday standby call containing an expected Mayday reset call transmission time and the Mayday center presumes that the vehicle station is experiencing an emergency situation when the Mayday reset call is not received within the expected transmission time.

11. The system according to claim 10, wherein the vehicle station, if a route where the vehicle station is going through has an area where the vehicle station cannot communicate with the Mayday center, predicts a lapse of time between entering and leaving the incommunicable area to determine an expected time of transmission of the Mayday reset call.

12. The system according to claim 10, wherein the vehicle station, when a route where the vehicle station is going through has a risky area, predicts a lapse of time between entering and leaving the risky area to determine an expected time of transmission of the Mayday reset call.

13. An emergency reporting device for a vehicle, comprising:

an emergency detecting device for detecting an occurrence of a vehicle emergency;

a vehicle location detecting device for detecting the location of the vehicle;

a communication device for transmitting an emergency call to a Mayday center to provide information regarding the location of the vehicle when the emergency occurs, the Mayday center generating an emergency report responsive the location information; and a table containing a plurality of emergency contact addresses to which the emergency report is transmitted when the emergency occurs, the table including data on the order of priority of the plurality of emergency contacts based on the location of the vehicle, wherein the emergency call transmitted by the communications device includes data on the order of priority of the emergency contacts.

14. The device according to claim 13, wherein the vehicle station communicates with the Mayday center by radio at a predetermined frequency for emergency reporting.

15. The device according to claim 13, wherein the table contains data on transmission methods of the emergency report to the plurality of emergency contact according to the content of the emergency.

16. An emergency reporting device for a vehicle, comprising:

an emergency detecting device for detecting an occurrence of a vehicle emergency;

a vehicle location detecting device for detecting the location of the vehicle;

a communication device for transmitting an emergency call to a Mayday center to provide information regarding the location of the vehicle when the emergency occurs, the Mayday center generating an emergency report responsive the location information; and a table containing a plurality of emergency contact addresses to which the emergency report is transmitted when the emergency occurs, the table including data on transmission methods of the plurality of emergency contacts, wherein the transmission of the emergency call transmitted by the communications device includes data on the transmission methods of the respective emergency contacts.

17. The device according to claim 16, wherein the table contains data on the transmission methods of the emergency report to the plurality of emergency contact according to the content of the emergency.

18. The device according to claim 16, wherein the transmission from the vehicle station to the Mayday center is performed at a predetermined frequency for emergency reporting.

19. An emergency reporting device for a vehicle, comprising:

a vehicle location detecting device for detecting the location of the vehicle; and a communication device for communicating with a Mayday center, wherein the communications device transmits a Mayday standby call to the Mayday center, the Mayday standby call containing an expected Mayday reset call transmission time based on a running route of the vehicle and the detected location of the vehicle.

20. The device according to claim 19, wherein the expected time of transmission, when the vehicle's route passes through an area where the vehicle cannot communicate with the Mayday center, is determined by predicting a lapse of time between entering and leaving the incommunicable area.

21. The device according to claim 20, wherein the expected time of transmission, when the vehicle's route passes through a risk area, is determined by predicting a lapse of time between entering and leaving the risk area.

22. A Mayday center for communicating with a vehicle station having a communications device, for dealing with an emergency call from the vehicle station, and for generating an emergency report said Mayday center comprising:

transmitting the emergency report to a plurality of emergency contacts based on the emergency call from the vehicle station; and determining an order of priority of the plurality of emergency contacts based on a location of the vehicle station.

23. The Mayday center according to claim 22, further including a table concerning the emergency contact according to the location of the vehicle station and determining the order of priority of the plurality of emergency contact according to the table.

24. A Mayday center for communicating with a vehicle station having a communications device, for dealing with an emergency call from the vehicle station, and for generating an emergency report, said Mayday center comprising:

transmitting the emergency report to a plurality of emergency contacts based on the emergency call from the vehicle station; and determining a method for transmitting the emergency report to addresses of the plurality of emergency contact based on the emergency contacts.

25. The Mayday center according to claim 24, further including a table of the plurality of emergency contact to which the emergency report is transmitted when an emergency takes place, the table also including data on transmission methods to the plurality of emergency contact.

26. A Mayday center for communicating with a vehicle station having a communications device, for dealing with an emergency call from the vehicle station, and for generating an emergency report, said Mayday center comprising:

receiving from the vehicle station, a Mayday standby call containing an expected Mayday reset call time of transmission; and presuming an occurrence of vehicle station emergency if a Mayday reset call is not received within the expected Mayday reset call transmission time.

* * * * *